United States Patent [19]

Blodee

[11] 4,154,476

[45] May 15, 1979

[54] SIDE-FOLDING, GANGED SEATING SYSTEM

[76] Inventor: Leif Blodee, 293 S. Lakeshore Dr., Holland, Mich. 49423

[21] Appl. No.: 919,262

[22] Filed: Jun. 26, 1978

[51] Int. Cl.[2] ..... A47C 1/122

[52] U.S. Cl. ..... 297/248; 297/42; 108/67

[58] Field of Search ..... 297/248, 42–45, 297/249; 108/67, 115, 113

[56] References Cited

U.S. PATENT DOCUMENTS

| | | | |
|---|---|---|---|
| 561,669 | 6/1896 | Koch | 297/248 X |
| 3,146,025 | 8/1964 | Heaney | 297/248 |
| 3,176,633 | 4/1965 | Balfour | 108/67 |
| 3,492,046 | 1/1970 | Wittner et al. | 297/248 |
| 3,640,568 | 2/1972 | Suzuki et al. | 297/248 |

*Primary Examiner*—Francis K. Zugel

*Attorney, Agent, or Firm*—Emrich, Root, O'Keeffe & Lee

[57] ABSTRACT

The system includes a side-folding, extendable frame comprising a plurality of generally U-shaped tubular frame members arranged on their sides so that the base of the "U" alternately forms rear and front legs for the frame. The ends of adjacent frame members are connected for rotation about horizontal axes by couplers which limit rotation of the frame members so that the frame has a zig-zag shape in the use position with all rear legs inclined toward one side of the frame and all front legs inclined uniformly toward the other side of the frame. Seats extend between and are supported by the frame members. Although various types of seating may be used, in a preferred embodiment, each seat is hinged at its side to an associated frame member, so that in the storage position, the frame members and seats are folded vertically to side-by-side relation, and the seats nest within each other for minimum space. A dolly may be used to fold the seating, and transport it to and from storage.

10 Claims, 22 Drawing Figures

Fig. 6
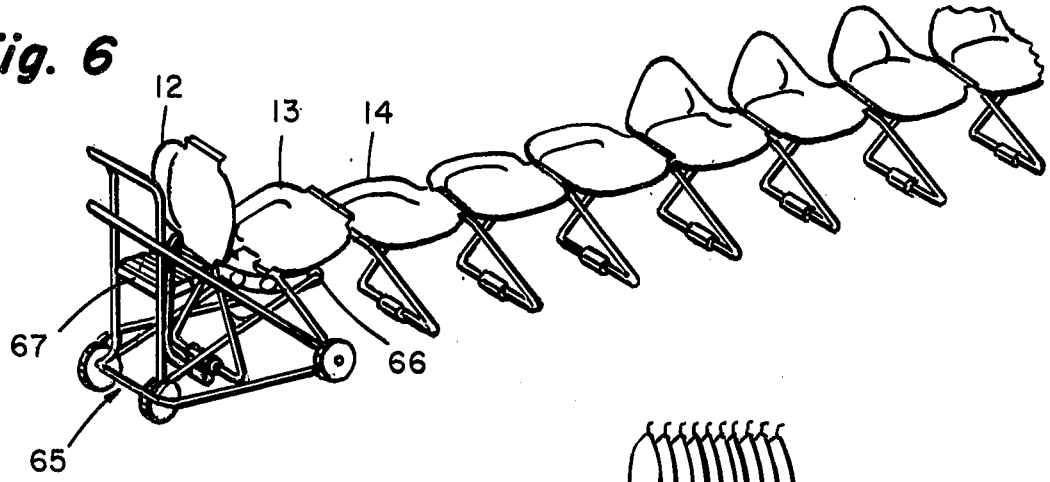
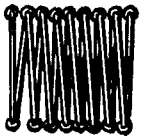
Fig. 7
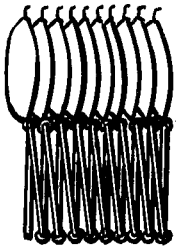
Fig. 8
Fig. 9
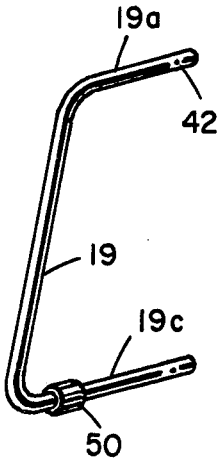
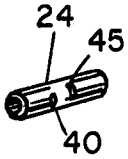
Fig. 10
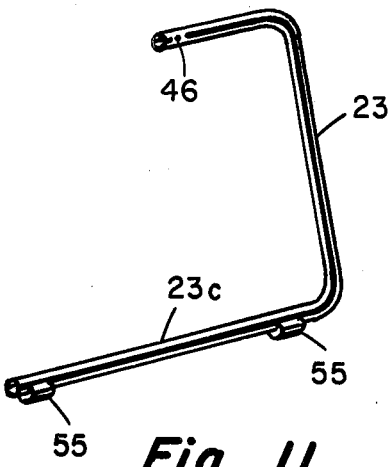
Fig. 11
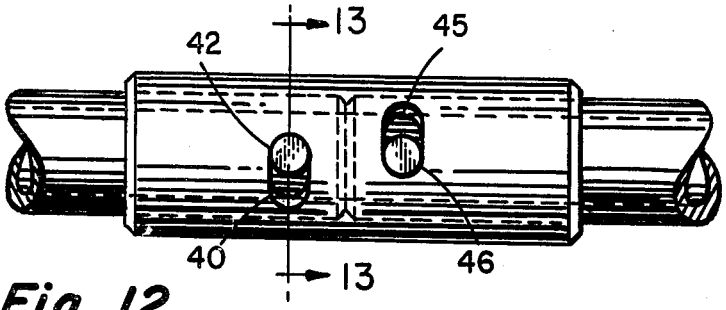
Fig. 12
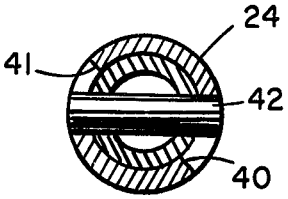
Fig. 13

SIDE-FOLDING, GANGED SEATING SYSTEM

BACKGROUND AND SUMMARY

The present invention relates to seating systems in general, and in particular, it relates to a seating system of the type in which seats are arranged in rows and ganged together as a unit. There has been a need in industry for seating of this type which provides the comfort and room of individual seats, insures that the seating is maintained in a straight row, yet which is easily and quickly folded and transported for storage, assuming a minimum space in the stored condition. Although such a need has existed for some time, attempts to fill all of these requirements have met with little or no commercial acceptance.

According to the present invention, a side-folding frame is provided from a plurality of tubular frame members. These individual frame members are twice-bent into a general U-shape. They alternately form front and rear portions of the frame, and are connected together by means of a coupling which limits rotation of the frame members in the use position. Thus, the frame members alternately form front and rear legs for the seating, and in the use position all of the front legs are inclined uniformly toward one side of a row and all rear legs are similarly inclined, but toward the other side of the row, thereby forming a zig-zag pattern when viewed from the front or rear. Because each of the individual U-shaped frame members is substantially coplanar, when the frame is folded for storage, the members are folded to a side-by-side relation, and become very compact.

Individual seats extend between and are supported by the upper horizontal portions of the connected frame members. Preferably, the seating is in the form of individual seats which are hinged at one side to the frame. Thus, for storage, the seats are rotated vertically and next within each other for minimum storage space. The seats of the preferred embodiment interlock with one another for stability, both in the use position and in the storage position. A dolly may be used to fold the seating and transport it to and from storage.

Other features and advantages of the present invention will be apparent to persons skilled in the art from the following detailed description of preferred embodiments accompanied by the attached drawing wherein identical reference numerals will refer to like parts in the various views.

THE DRAWING

FIG. 6 is a perspective view similar to FIG. 4 illustrating the use of a dolly for folding the system for storage;

FIG. 7 is a front elevational view of the frame in the folded position;

FIG. 8 is a front elevational view of the system of FIG. 1 in the folded, storage position;

FIGS. 9, 10 and 11 are perspective views of a front frame member, coupler, and side frame member which, taken together, show the elements in exploded relation;

FIG. 12 is a side view of a coupler assembled to an associated front and rear frame member;

FIG. 13 is a transverse cross sectional view taken through the sight line 13—13 of FIG. 12;

DETAILED DESCRIPTION

Figure 1:
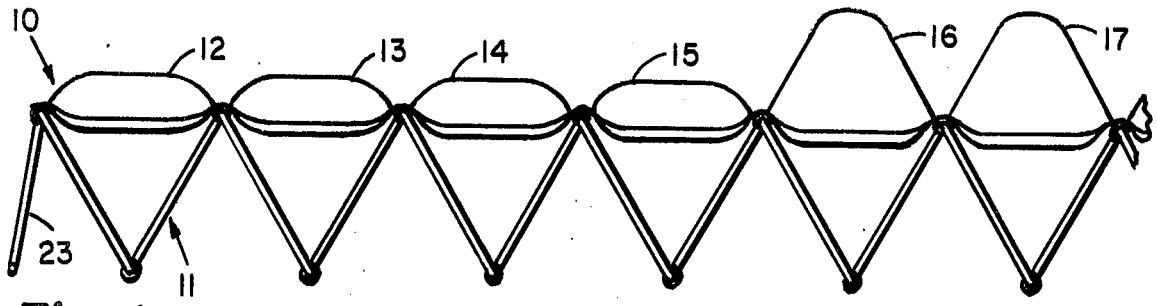
FIG. 1 is a fragmentary front elevational view of a seating system incorporating the present invention.
Figure 2:
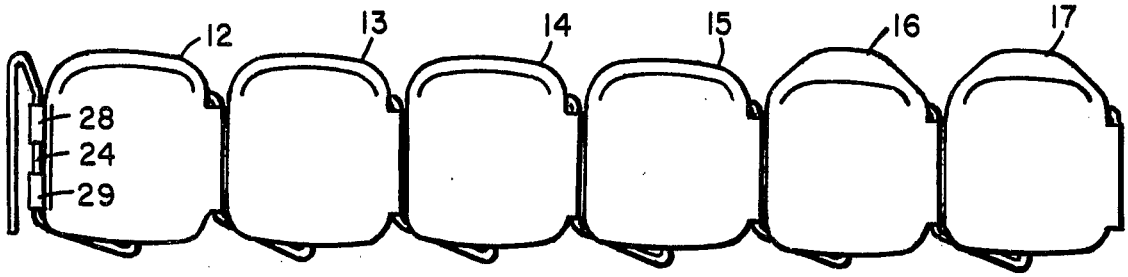
FIG. 2 is a plan view of the system of FIG. 1.

Referring to FIG. 1, there is seen the left side of a row of ganged seating, generally designated by reference numeral 10 and including a frame generally designated 11, and individual seats. In the illustrated embodiment, the four seats on the left end of the row are designated respectively 12, 13, 14 and 15; and the next two seats which are shown are designated 16 and 17. All of the seats may be formed of plastic by conventional techniques. Thus, each of the seats 12–17 is a plastic shell. The four left seats 12–15 do not have lower back supports, whereas the other seats in the row do have such supports. The reason for this is to illustrate that different types of seats may be employed and further, in the illustrated embodiment, when the seats are folded, the back supports do not project beyond the stack, thereby further reducing storage requirements.

Figure 3:
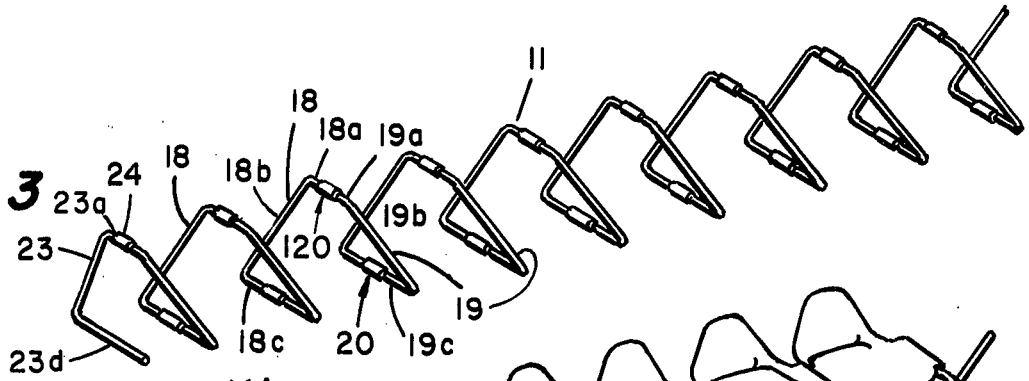
FIG. 3 is an upper, side perspective view of the frame of the system of FIG. 1 shown in the use position.

Turning now to FIG. 3, the frame 11 is seen to comprise a plurality of individual frame members which are divided into rear frame members designated 18 and front frame members 19, although these frame members may be similar in structure. Each of the frame members is preferably formed from a piece of metal tubing into a general U-shape, and is turned on its side. Thus, each rear frame member includes an upper horizontal portion 18*a*, an inclined leg portion 18*b* (which forms the base of the U-shape), and a lower horizontal portion 18*c*. Similarly, each of the front frame members includes an upper horizontal portion 19*a*, a forward leg portion 19*b*, and a lower horizontal portion 19*c*. Adjacent frame members are connected together by rotational couplers, generally designated by reference numeral 20 so that the overall frame may be extended for use and retracted for storage. Thus, aligned upper portions 18*a* and 19*a* of rear and front frame members respectively are connected together by one coupler 20, and similarly, lower portions 18*c*, 19*c* are connected together by a coupler.

The aligned upper horizontal portions of adjacent frame members 18*a*, 19*a*, when thus connected together cooperate to provide a side seat support; and the lower horizontal portions 18*c*, 19*c* when thus connected together provide a common floor runner.

The rear frame member on the left side, designated 23 is similar to the other individual frame members except that it is provided with an elongated lower horizontal portion 23*d* for additional support. This same element, when turned around, may be used for the right end frame member. In addition, the coupler 24 which connects the end frame member to the second frame member limits the rotation of that member (see FIG. 1) so that it does not protrude out into the aisle.

Figure 4:
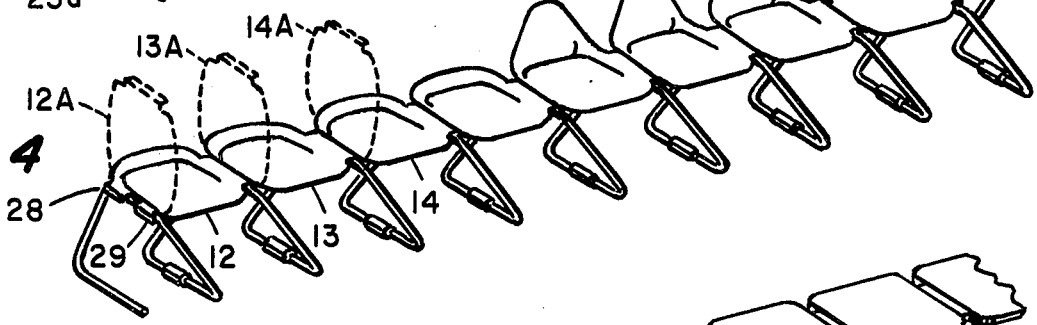
FIG. 4 is a perspective view, taken from the front and side of the system of FIG. 1 showing some of the seats in the storage position in dashed line.

Each of the seat shells includes, at its left side (when viewed from the front) a pair of integrally molded tubular hinge connectors 28, 29 which slidably receive the upper horizontal portion 18*a* (or, in the case of an end frame member, 23*a*) and the upper horizontal portion 19*a* of a front frame member respectively. The coupling 20 (or 24) may be located in the space between the tubular hinges 28, 29 to limit fore-to-aft sliding of the shell. As will be described, the right side of each seat shell is releasably connected to the next adjacent shell in the use position, so that each seat shell may be rotated upwardly (see the dashed positions 12A–14A in FIG. 4). When the seats are lowered to the use position, they interconnect with each other and with the horizontal seat rest portions of the frame to lock the frame in the extended use position in which, as can be seen from FIG. 1, the frame takes a zig-zag form. When the seats are raised, the frame may be folded to the compact form of FIG. 7 in which the adjacent front and rear frame members are in side-by-side relation, and the seat shells are upright and nested (see FIG. 8).

Figure 20:
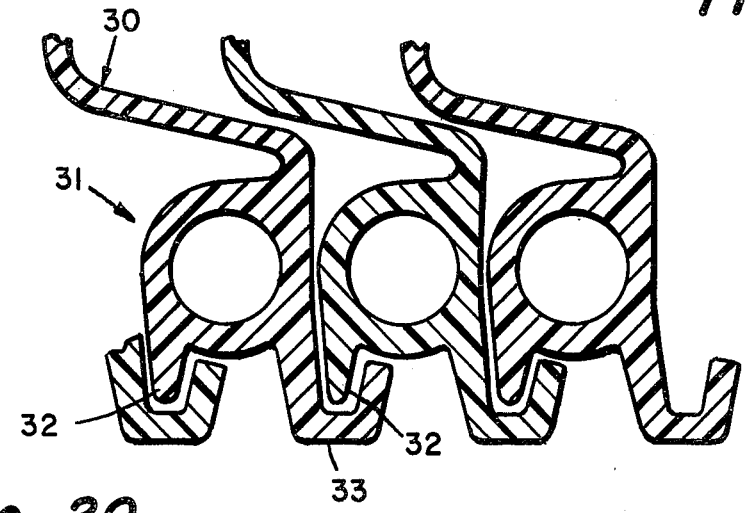
FIG. 20 is a close up fragmentary vertical cross sectional view taken through the hinge connection of the seats and showing the seats in the storage position.
Figure 21:
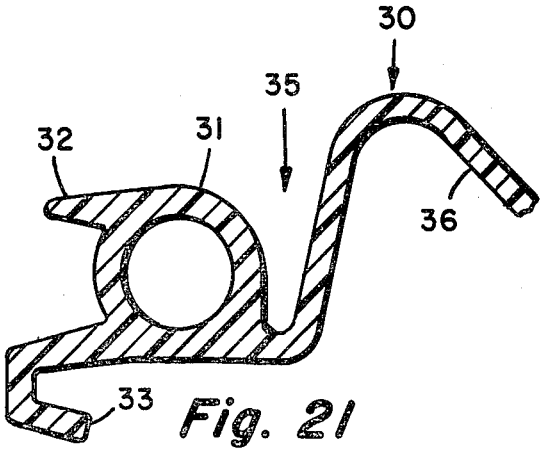
FIG. 21 is a view similar to FIG. 20, but showing the portion of an individual seat in the use position.
Figure 22:
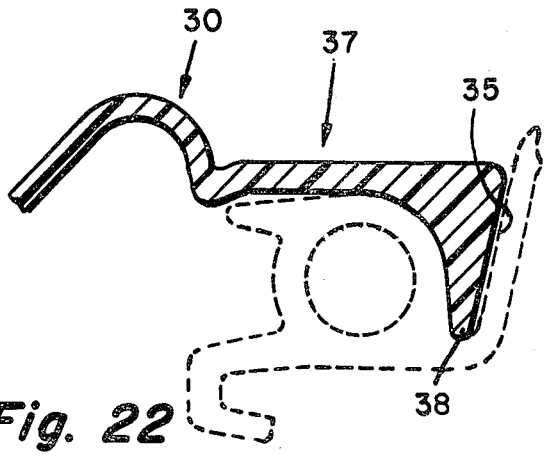
FIG. 22 is a close up fragmentary cross sectional view showing the interlocking of adjacent seats in the use position.

Turning now to FIGS. 20–22, the left side or hinge portions of individual seat shells are shown in the upright, locked position in FIG. 20, and, for an individual shell in the use position, in FIG. 21. One shell is generally designated by reference numeral 30, and its seat panel has a general concave body contour. At the left side, the seat panel forms a groove 35 and is then joined to a tubular hinge 31. Integrally molded with the hinge 31 is a projection 32 which forms a latch in the raised position, and a hook 33. In the vertical position, as the frame is folded, the projection 32 of one seat is received in the hook 33 of the next adjacent seat, as seen in FIG. 20, thereby interconnecting the seats and locking them in the storage position.

Referring now to FIG. 21, the elongated groove 35 is formed between the tubular side hinges (one of which is shown at 31) and the seat panel 36. At the right side of the seat panel, a horizontal flange or extension generally designated 37 is formed, and at its right edge, a depending hook 38 is provided for fitting into the corresponding groove 35 of the next adjacent seat for locking the frame in the extended use position when the seat is lowered.

Figure 5:
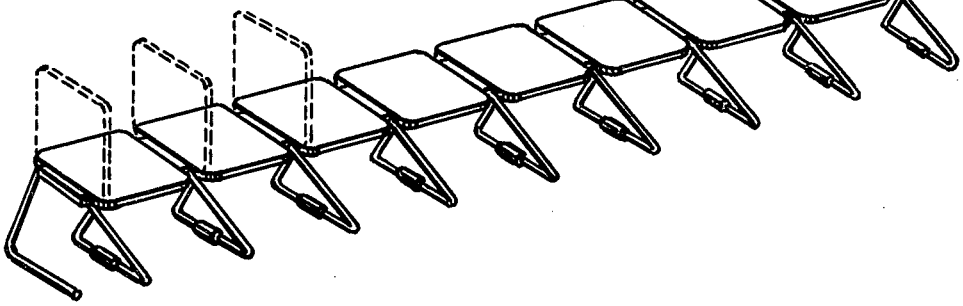
FIG. 5 is a perspective view, taken from the upper front side of an alternative embodiment wherein flat seats are provided, as for a bench.

Because of this construction, the shell may take any number of forms, such as the flat shape shown in FIG. 5. This can provide bench type seating, foot rests or tables, depending upon the application.

Referring to FIGS. 9–13, the coupling 24 takes the form of a tube having a first pair of aligned slots 40, 41 (see FIG. 13) in which a pin 42 is received. The pin 42 (see FIG. 9) is press-fit into an aperture formed near the inboard end of the upper horizontal portion of a frame member. A similar pair of diametrically aligned slots, one of which is shown at 45 in FIG. 10, receives a pin 46 on the end frame member 23. The slots 40, 41 are angularly offset from the second pair of aligned slots. The degree of this offset as well as the length of the slot define the limit of angular displacement between the two frame members connected by the coupling. Thus, the couplings 20 may be similar to the one described but the aligned pairs of slots would be at a greater displacement to permit the frame members to open wider.

Figure 14:
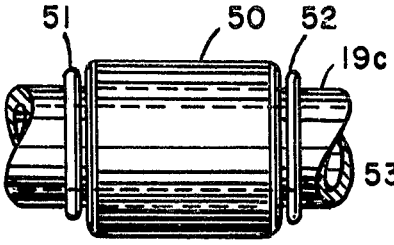
FIG. 14 is a close up fragmentary view of a cushion element used on a lower runner of the frame.
Figure 15:
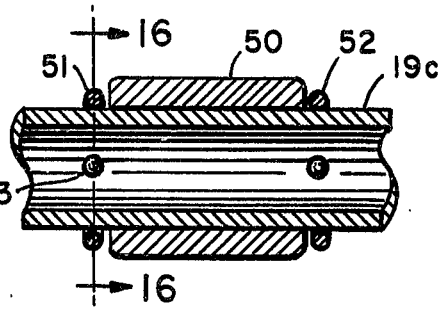
FIG. 15 is a longitudinal cross sectional view of the component of FIG. 14.
Figure 16:
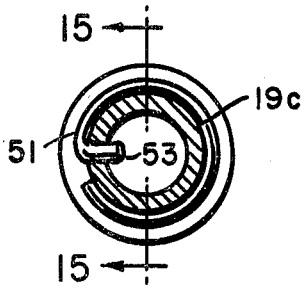
FIG. 16 is a transverse cross sectional view of the component of FIG. 14.

The runner portion of each frame member (see 19*c* in FIG. 9) is provided with a cylindrical cushion element 50 which is received on the frame member and held by a pair of spring retainer members 51, 52 (see FIGS. 14–16) which, in turn, are secured to the frame by means of an inwardly turned end portion (see 53 in FIG. 16) received in an aperture in the frame.

Figure 17:
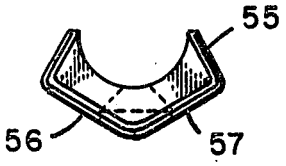
FIG. 17 is an end view of a floor cushion for an end runner on the frame.
Figure 18:
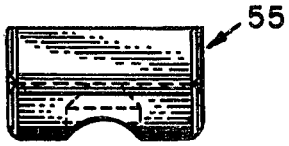
FIG. 18 is a side view of the component of FIG. 17.
Figure 19:
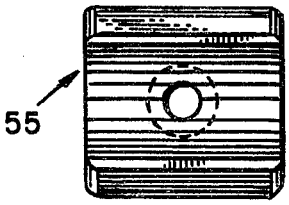
FIG. 19 is a top view of the component of FIG. 17.

The runner portion 23*c* of each end frame member is provided with a pair of fixed cushion members 55, and seen in more detail in FIGS. 17–19. These cushions may be fixed by rivets or staked, and they include a lower floor-engaging surface comprising inclined portions 56, 57. Depending upon whether the frame member forms a front leg or a rear leg, one of the inclined surfaces 56, 57 will engage the floor and limit lateral sliding of the row.

Referring now to FIG. 6, a wheeled dolly is generally designated 65, and it includes a forward roller or bumper 66 which is arranged at a height so as to fit beneath a seat, yet engage the bottom of the seat, to bump it loose from its connection to the next adjacent seat. This unlocks the frame and permits it to be folded to the shape of FIG. 7. The dolly is also provided with an upwardly inclined ramp 67 leading from the bumper roller 66, to raise the folded frame and chairs as they are straightened, so they do not drag on the floor as the dolly is pushed along. The seats are thus rotated to the upright, folded position as the frame is folded, and the seats nest in the position of FIG. 8. The dolly may be used to transport the folded seating to and from storage. Thus, the arranging and folding of the seating cam be accomplished by a single workman.

Having thus disclosed in detail preferred embodiments of the invention, persons skilled in the art will be able to modify certain of the structure which has been illustrated and to substitute equivalent elements for those disclosed while continuing to practice the principal of the invention; and it is, therefore, intended that all such modifications and substitutions be covered as they are embraced within the spirit and scope of the appended claims.

I claim:

1. A seating system comprising: a side-folding, extendable frame including a plurality of frame members each frame member comprising an upright leg portion and upper and lower generally parallel horizontal portions, alternate ones of said frame members arranged to face opposite forward and rear directions whereby said leg portions alternately form rear and forward legs of said seating system, the upper horizontal portions and the lower horizontal portions of adjacent frame members being axially aligned to form seat rests and floor runners respectively; coupling means for connecting the aligned upper horizontal portions of adjacent frame members and for connecting aligned lower horizontal portions of adjacent frame members while permitting limited rotation thereof; and a plurality of seating means, each hingedly connected at one side to one of said seat rest portions of said frame and rotatable between an upright storage position and a horizontal use position, the free end of each seating means being supported by the next adjacent seat rest portion of said frame in the use position.

2. The apparatus of claim 1 wherein said seat means comprise a plurality of plastic shells molded to nest with one another in the upright storage position and to interlock with an adjacent shell in the use position to secure said frame in the extended position.

3. The apparatus of claim 2 wherein said seat shells define tubular hinge means for receiving the horizontal upper portions of adjacent frame members while permitting said seat means to rotate about said seat rest portions of said frame.

4. The apparatus of claim 3 wherein each of said seat members defines an elongated groove between a seat panel and said tubular hinge means, and, on the side opposite said connector, each seat defines a depending member adapted to fit into and couple with the groove of the next adjacent seat in the use position, thereby to interconnect all of said seats and stabilize said frame when extended.

5. The apparatus of claims 1 or 4 wherein each of said frame members is formed from an integral piece of tubing of round cross section and having a general U-shape turned on its side.

6. The apparatus of claim 5 wherein each end frame section further includes an elongated lower horizontal portion providing a full length floor runner.

7. The apparatus of claim 5 wherein said coupling means comprises a tubular member having first and second pairs of diametrically aligned slots, and a pin affixed adjacent the distal end of each horizontal upper and lower portion of an associated frame member at which a coupling is located, said pins of adjacent frame members being received in respective pairs of said aligned slots in said coupling, said pins and slots cooperating to limit the rotation of adjacent frame members in the use position.

8. The apparatus of claim 7 further comprising a tubular cushion on the runner portion of each intermediate frame member.

9. The apparatus of claim 7 wherein each end frame member includes forward and rear floor cushions defining a pair of inclined floor-engaging surfaces for reducing lateral sliding of said unit in the use position.

10. The apparatus of claim 3 further comprising a wheeled dolly including bumper means adapted to be received into a side of said frame to engage and unlock said seats seriatim, said dolly further including upwardly inclined support means leading from said bumper means to raise and fold said frame members to side-by-side relation as said dolly is pushed along said seating.

* * * * *